US007128029B2

(12) United States Patent
Paul et al.

(10) Patent No.: US 7,128,029 B2
(45) Date of Patent: Oct. 31, 2006

(54) WATER-COOLED CYLINDER HEAD FOR A MULTICYLINDER INTERNAL-COMBUSTION ENGINE

(75) Inventors: Michael Paul, Weissach (DE); Frank Ickinger, Pleidelsheim (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 11/264,350

(22) Filed: Oct. 20, 2005

(65) Prior Publication Data

US 2006/0054112 A1 Mar. 16, 2006

Related U.S. Application Data

(63) Continuation of application No. PCT/EP05/02723, filed on Mar. 15, 2005.

(30) Foreign Application Priority Data

Mar. 27, 2004 (DE) ..... 10 2004 015 134

(51) Int. Cl.
*F02F 1/36* (2006.01)

(52) U.S. Cl. ..... 123/41.82 R

(58) Field of Classification Search ..... 123/41.82 R
See application file for complete search history.

(56) References Cited

U.S. PATENT DOCUMENTS 4,690,104 A 9/1987 Yasukawa
4,699,092 A 10/1987 Ruf et al.
2002/0124815 A1 9/2002 Ishiguro et al.

FOREIGN PATENT DOCUMENTS

DE 4116943 C1 6/1992
GB 1134200 11/1968
WO WO 2004/022961 A1 3/2004

*Primary Examiner*—Noah P. Kamen
(74) *Attorney, Agent, or Firm*—Crowell & Moring LLP

(57) ABSTRACT

A water-cooled cylinder head is provided for a multicylinder internal-combustion engine having two inlet and outlet valves per cylinder. The cylinder head has a cylinder head cooling space with inflow and outflow openings for the coolant which is integrated in the cylinder head housing and extends above a part-spherical cap forming a combustion chamber volume. Water cooling spaces are formed at least in areas around a receiving opening for a spark plug arranged centrally in the cylinder head housing and around the two outlet valves. The water cooling spaces are mutually connected by way of a common annulus section. At least the common water cooling jacket annulus section has a volume which remains an essentially constant distance from the combustion chamber volume, so that, at least in this area, the wall thickness of the part-spherical combustion chamber cap extends in a uniform manner and to close to the combustion chamber volume.

20 Claims, 5 Drawing Sheets

WATER-COOLED CYLINDER HEAD FOR A MULTICYLINDER INTERNAL-COMBUSTION ENGINE

This application is a continuation of International Patent Application No. PCT/EP2005/002723 filed on Mar. 15, 2005, designating the United States of America, the entire disclosure of which is incorporated herein by reference. Priority is claimed based on German Patent Application No. DE 10 2004 015 134.2 filed Mar. 27, 2004.

BACKGROUND AND SUMMARY OF THE INVENTION

The invention relates to a water-cooled cylinder head for a multicylinder internal-combustion engine. The preferred embodiment relates to a water-cooled cylinder head for a multicylinder internal-combustion engine having two inlet and outlet valves per cylinder, comprising a cylinder head cooling space with inflow and outflow openings for the coolant which is integrated in a cylinder head housing and extends above a part-spherical cap forming a combustion chamber volume. Water cooling spaces are formed at least in areas around a receiving opening for a spark plug arranged centrally in the cylinder head housing and around two outlet valves. The water cooling spaces are mutually connected by way of a common water cooling jacket annulus section.

Particularly in high-performance engines, temperature peaks of up to 300° C. occur, despite water-cooled cylinder heads and because of the high specific performance, particularly in areas between the outlet valves or between the outlet valves and the spark plugs. These temperature peaks result in temperature stress in the material and, in connection with external loads, in permanent deformations in the valve seat ring areas of the outlet valves.

It is therefore an object of the invention to overcome the above-mentioned disadvantages and to improve the cooling in the highly stressed areas of the cylinder head housing.

This object is achieved according to certain preferred embodiments of the invention by providing a water-cooled cylinder head for a multicylinder internal-combustion engine having two inlet and outlet valves per cylinder. The cylinder head includes a cylinder head cooling space with inflow and outflow openings for the coolant which is integrated in a cylinder head housing and extends above a part-spherical cap forming a combustion chamber volume. Water cooling spaces are formed at least in areas around a receiving opening for a spark plug arranged centrally in the cylinder head housing and around two outlet valves. The water cooling spaces are mutually connected by way of a common water cooling jacket annulus at section. At least the common water cooling jacket annulus section has a volume which remains an essentially constant distance from the combustion chamber volume, so that, at least in this area, the wall thickness of the part-spherical combustion chamber cap extends in a uniform manner and so as to close to the combustion chamber volume.

Since the joint water cooling jacket annulus section between the two outlet valves and the receiving opening for the spark plug has a volume remaining an essentially constant distance from and extending close to the combustion chamber volume, the temperature peaks in this area can be effectively reduced. Instead of high-temperature cylinder head alloys, such as AlCu5Ni1,5CoSbZr, it is thus also possible to use less expensive standard alloys, such as AlSi6Cu4 or AlSi7MG. On the other hand, by lowering the temperature, the knocking tendency of the engine is reduced, so that, because of the ignition angle improvements, consumption advantages and a corresponding power increase can be achieved.

Additional advantageous features of preferred embodiments of the invention are described herein and in the claims.

According to certain preferred embodiments of the invention, for a fast and effective heat dissipation in the area of the spark plug dome, it is suggested to reduce the diameter of the receiving opening for the spark plug at the level of the joint water cooling jacket annulus section. This can be implemented by constructing the thread of the spark plug in this area with an outside diameter which is reduced with respect to the spark plug housing.

Tests have shown that optimal cooling of the highly stressed points is ensured with a simultaneously sufficient dimensional stability, particularly of the part-spherical combustion chamber cap, when the wall thickness of the spherical combustion chamber cap is reduced, at least in the area of the joint annulus section, to between 5 and 11 mm, according to certain preferred embodiments of the invention.

According to certain preferred embodiments of the invention, an additional cooling duct in the form of an injector bore ensures that the joint annulus section is directly supplied with cooling water.

According to certain preferred embodiments of the invention, another improvement or optimization of the cooling of the cylinder head housing is achieved when the water cooling jacket in the area of the spherical combustion chamber cap and of the inlet and outlet ducts monitored by the valves has an essentially uniform wall thickness between 3 and 7 mm. As a result of the constant water cooling jacket thickness, higher flow rates of the cooling water can be achieved and the heat transmission can thereby be improved.

According to certain preferred embodiments of the invention, adequate cooling is achieved by a main cooling flow which extends between the two outlet valves in the direction of the receiving opening for the spark plug, while two secondary cooling flows are formed on the outside on the two outlet valves.

According to certain preferred embodiments of the invention, by means of a targeted throttling of the two secondary cooling flows by corresponding contractions in the corresponding cooling ducts, it is ensured that the main cooling quantity is guided directly into the spark plug area.

The drawings illustrate an embodiment of the invention which will be described in detail in the following.

Other objects, advantages and novel features of the present invention will become apparent from the following detailed description of the invention when considered in conjunction with the accompanying drawings.

DETAILED DESCRIPTION OF THE DRAWINGS

Figure 1:
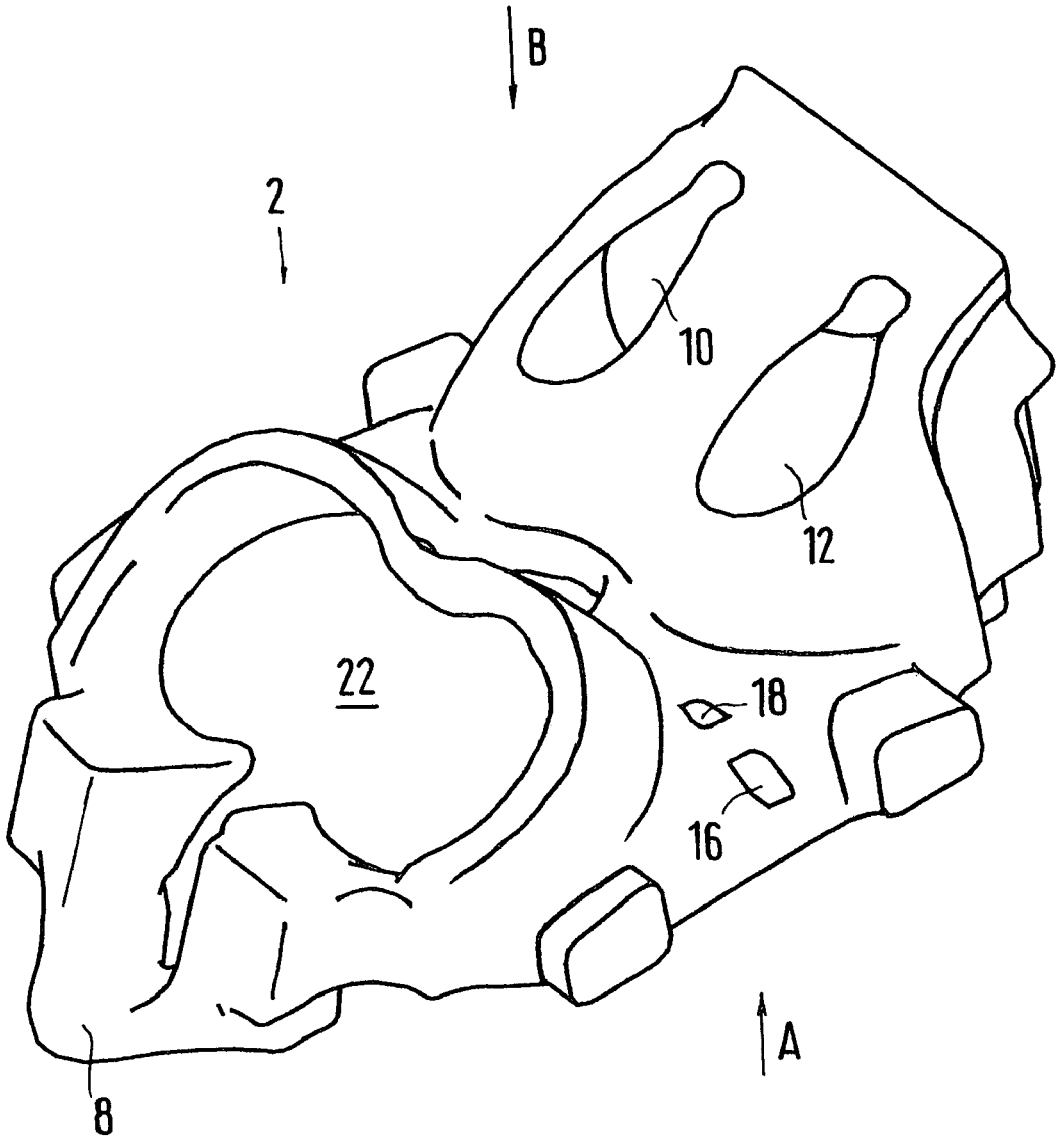
FIG. 1 is a geometrical representation of a water cooling jacket in a cylinder head housing of an internal-combustion engine.

FIGS. 1 to 4 illustrate the geometry of a water cooling jacket, called a cylinder head cooling space 2 in the following description, which is integrated in a cylinder head housing 4 of a multicylinder internal-combustion engine.

The cylinder head cooling space 2 of each cylinder is supplied with cooling water by way of a central inflow opening 6 in the cylinder head housing 4. On the opposite side of the cylinder head cooling space 2, a delta-shaped outflow opening 8 is provided, by way of which the coolant warmed up by the cylinder head housing 4 flows off to the suction side of the water pump, which is not shown, of the internal-combustion engine. In the geometrical representation of the cylinder head cooling space 2, two recesses 10 and 12 are visible for the two outlet valves or outlet ports of the internal-combustion engine. An opening 14 centrally provided in the cylinder head cooling space 2 forms the receiving device or the dome for a spark plug (not shown) of the corresponding cylinder. On the left and the right of the central opening 14, two web-shaped recesses 16 and 18 are provided in the cylinder head housing 4. The recesses form two webs reaching through the water cooling jacket 2 by which the part-spherical combustion chamber volume 20 constructed in the cylinder head housing 4 is hung up or supported.

Viewed in the flow direction of the coolant, a recess 22 for the two inlet valves or inlet ducts of the cylinder head section adjoins the two web-shaped recesses 16, 18 and the central opening 14.

Figure 2:
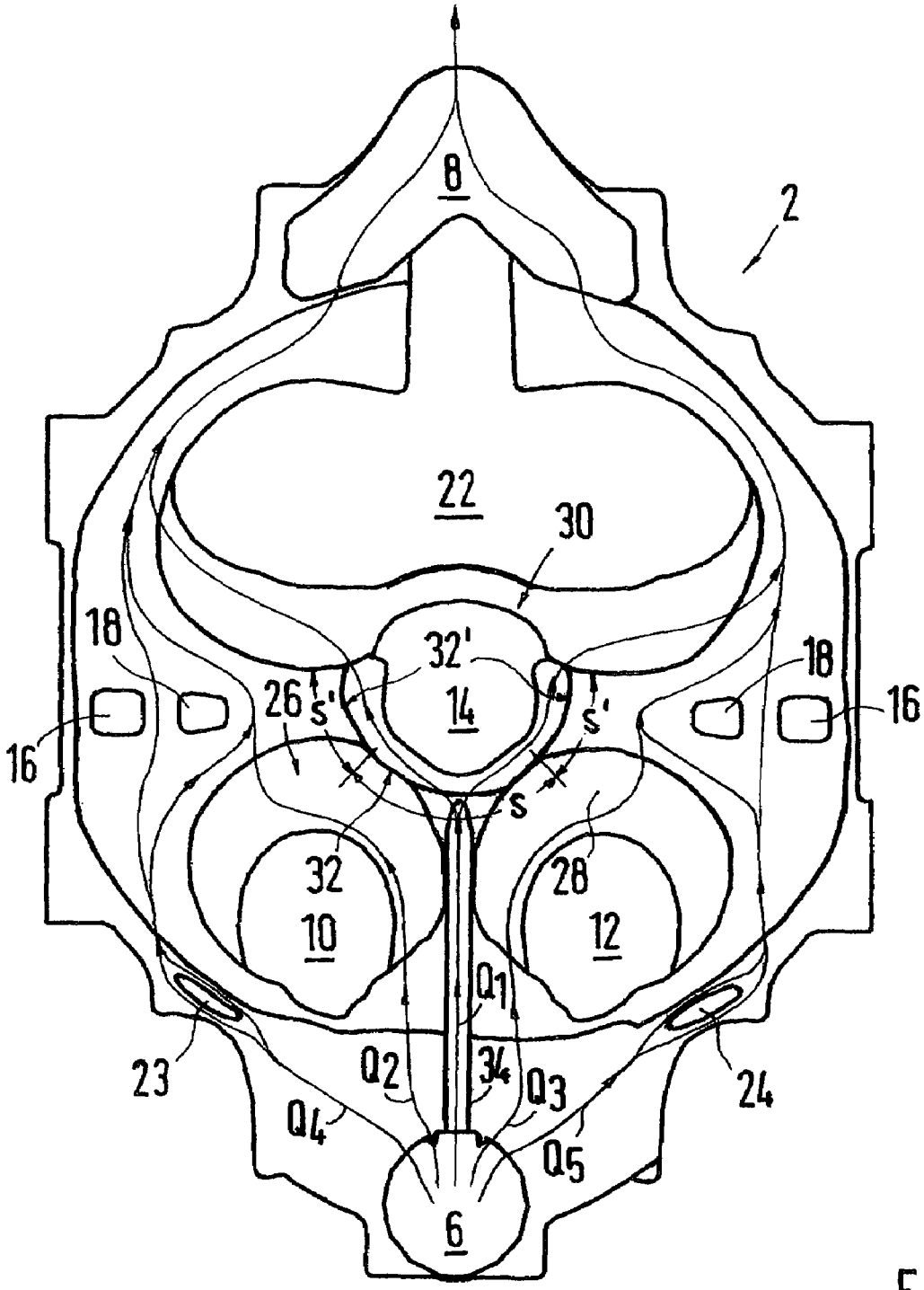
FIG. 2 is a view of the water cooling jacket in viewing direction A according to FIG. 1.
Figure 3:
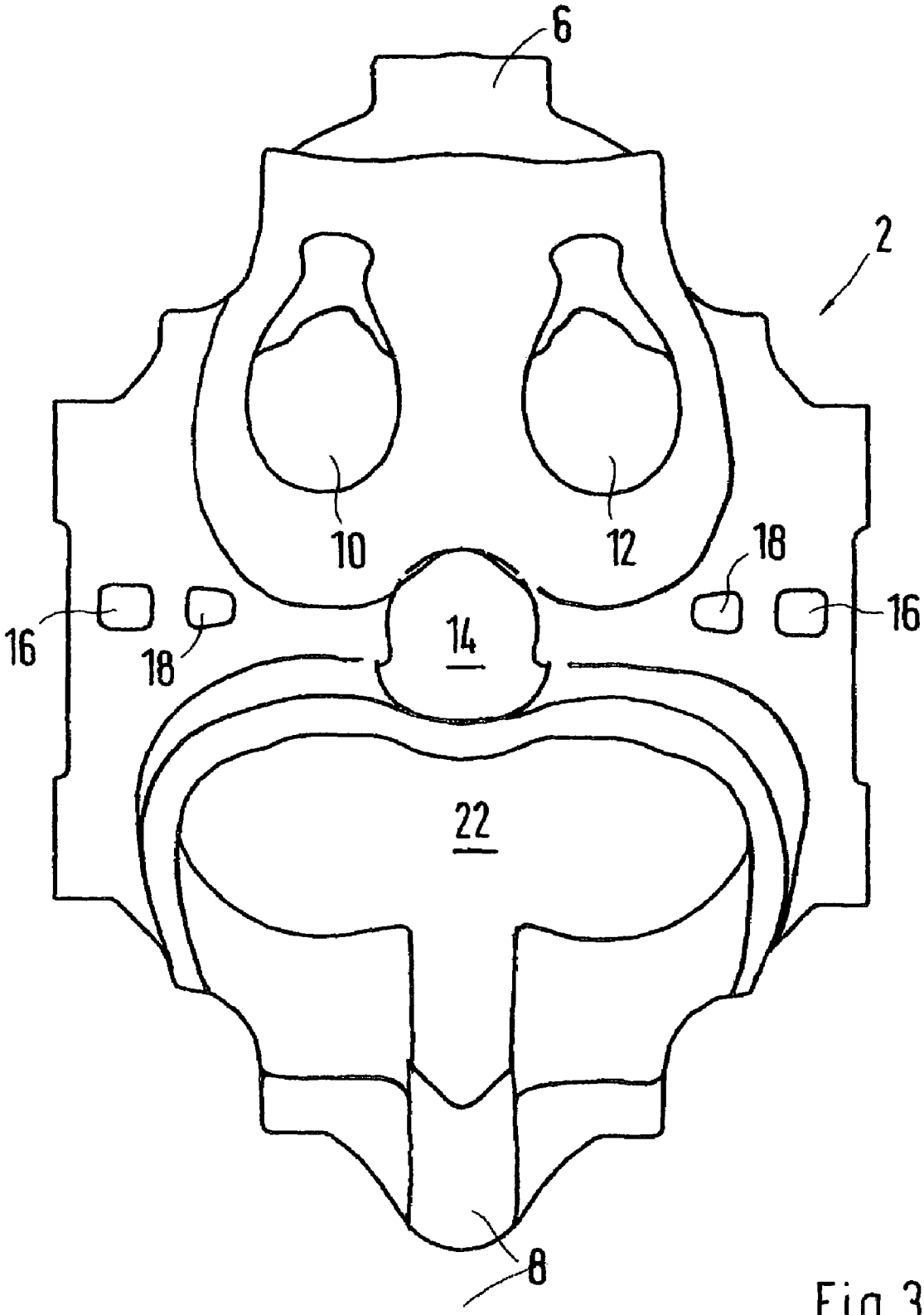
FIG. 3 is a view of the water cooling jacket in viewing direction B according to FIG. 1.
Figure 4:
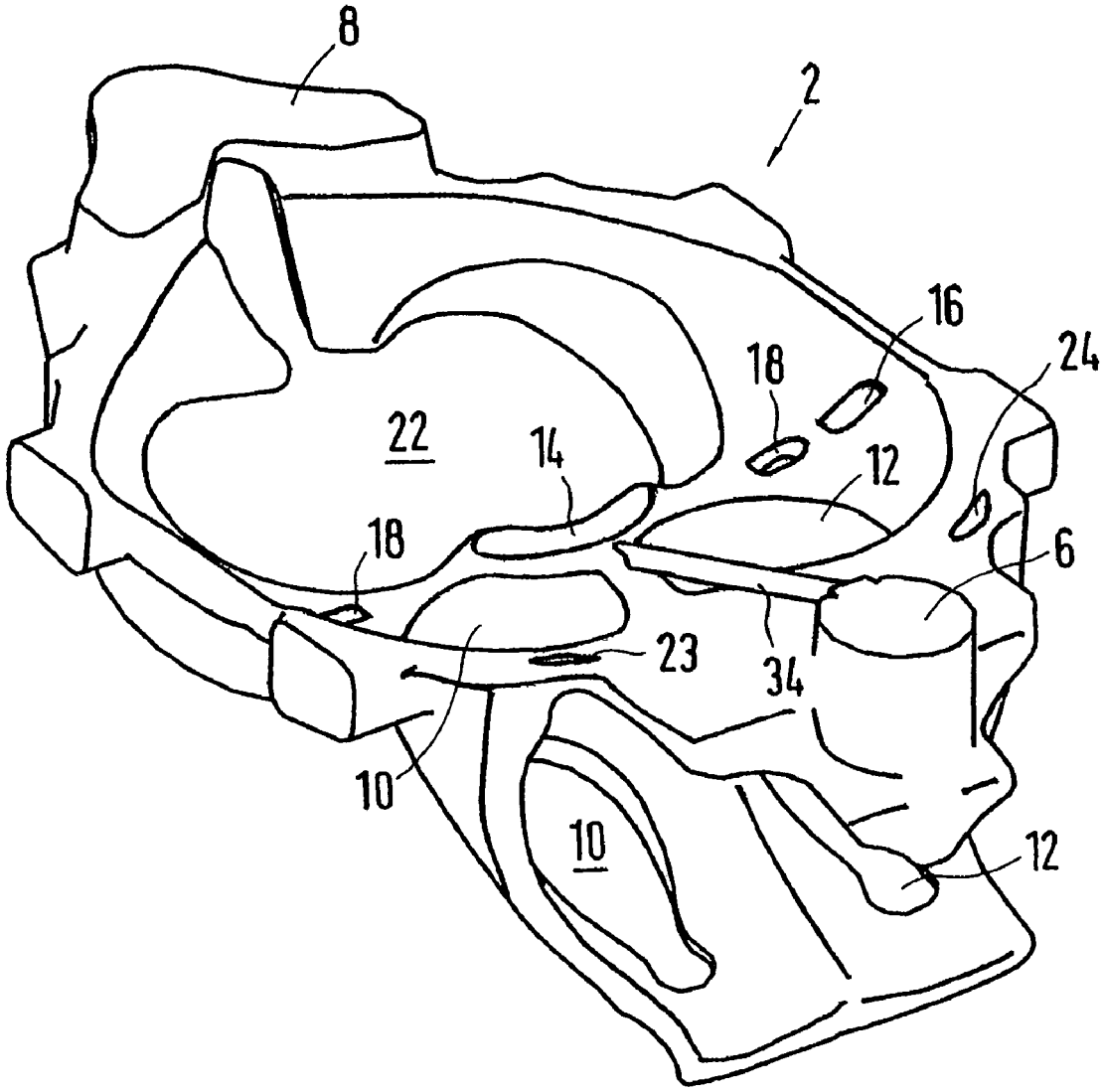
FIG. 4 is a diagonal view of the water cooling jacket in viewing direction A according to FIG. 1.

On the inflow side of the coolant, two additional recesses 23 and 24 are visible in the cylinder head cooling space 2. Flow contractions in the cylinder head cooling space 2 have a function which will be discussed below. As illustrated in FIG. 2, water cooling jacket spaces are formed around the two outlet valves and around the spark plug. These spaces in the present case form closed annuli 26, 28 and 30. In this case, annulus 30 adjoins the two other annuli 26, 28, so that a common central annulus section 32 is formed. A cooling duct 34 constructed in the form of a bore in the cylinder head housing 4 leads from the inflow opening 6 directly to the common annulus section 32 and additionally directly supplies this high-temperature-stressed area with cooling water.

Figure 5:
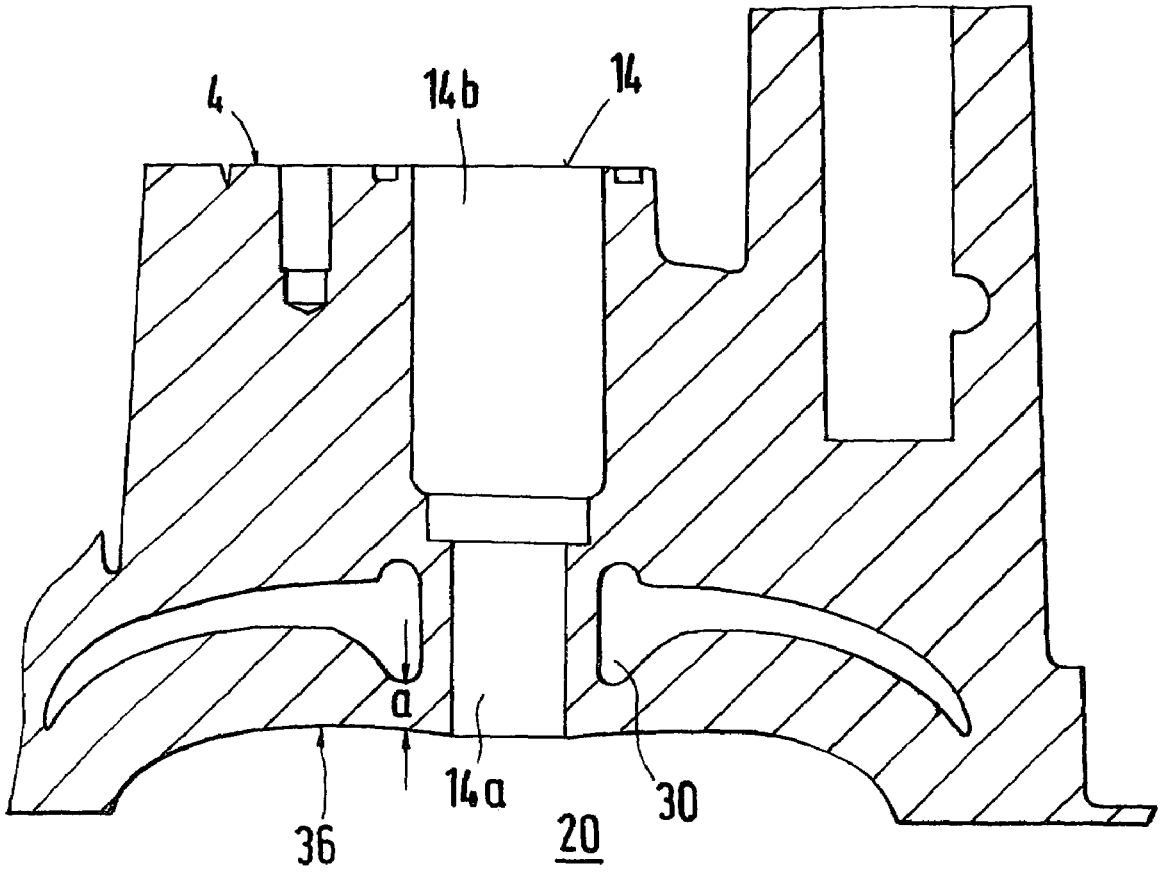
FIG. 5 is a sectional view of a portion of the cylinder head housing in the receiving area for the spark plug.

The central annulus section 32 extending along the curve length s (see FIG. 2) has a volume which remains essentially the same distance from the combustion chamber volume 20, so that, at least in this area, the wall thickness a (FIG. 5) of the part-spherical combustion chamber cap 36 is uniform and, in the vertical direction, extends to close to the combustion chamber trough 20. In this case, the wall thickness a of the spherical combustion chamber cap 36 in the area of the annulus section 32 is reduced to between 5 and 10 mm. As illustrated in FIG. 5, a section 14*a* of the receiving opening 14 for the spark plug is reduced in its diameter with respect to the section 14*b* situated above it. The ignition plug thread is placed in section 14*a* of the receiving opening 14, the length of the thread having intentionally been selected such that the central annulus section 32 as well as the two annulus sections 32' adjoining the latter on the left and the right extend with their curve lengths s' in the vertical direction exclusively at the level of the reduced thread diameter (section 14*a*), so that the water cooling jacket or the cylinder head cooling space 2 extends to close to the spark plug dome.

For increasing the flow rate of the cooling water, the cylinder head cooling space 2 has an essentially uniform thickness in the area of the part-spherical combustion chamber cap 36 and of the inlet and outlet valves, which thickness amounts to between 3 and 7 mm.

By means of the above-described measures, the temperature peaks caused as a result of the high heat entry to the spark plug and the valve seat rings in this area can be effectively reduced.

The flow cross-sections on the inflow side of the cylinder head cooling space 2 are constructed such that the cooling water flow is divided into a main cooling flow $Q_1$, $Q_2$ and $Q_3$ as well as into two secondary cooling flows $Q_4$ and $Q_5$. The main cooling flow $Q_1$, $Q_2$ and $Q_3$ is guided between the two outlet valves (recess 10, 12) in the direction of the spark plug dome (central opening 14), while the secondary cooling flows $Q_4$ and $Q_5$ extend in the left and the right edge area of the cylinder head cooling space 2 respectively. The initially mentioned recesses 23, 24 form contractions for the two secondary cooling flows $Q_4$ and $Q_5$, so that the entire cooling water flow is, for example, divided such that 50% thereof is guided by way of the main cooling flow $Q_1$, $Q_2$ and $Q_3$ between the two outlet valves in the direction of the spark plug dome, while, in each case, 25% thereof is fed by way of the secondary cooling flows $Q_4$ and $Q_5$ to the left and the right edge area of the cylinder head cooling space.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Water-cooled cylinder head for a multicylinder internal-combustion engine having two inlet and outlet valves per cylinder, comprising a cylinder head cooling space with inflow and outflow openings for the coolant which is integrated in a cylinder head housing and extends above a part-spherical cap forming a combustion chamber volume, water cooling spaces being formed at least in areas around a receiving opening for a spark plug arranged centrally in the cylinder head housing and around the outlet valves, which water cooling spaces are mutually connected by way of a common water cooling jacket annulus section, wherein at least the common water cooling jacket annulus section has a volume which remains an essentially constant distance from the combustion chamber volume, so that, at least in this area, the wall thickness of the part-spherical combustion chamber cap extends in a uniform manner and to close to the combustion chamber volume.

2. Water-cooled cylinder head according to claim 1, wherein the diameter of a receiving opening for the spark plug is reduced at the level of the common annulus section.

3. Water-cooled cylinder head according to claim 2, wherein the wall thickness of the part-spherical combustion chamber cap in the area of the annulus section is reduced to between 5 and 11 mm.

4. Water-cooled cylinder head according to claim 3, wherein an additional cooling duct is provided on the inflow side of the cooling water, which additional cooling duct supplies the common annulus section on a direct path additionally with cooling water.

5. Water-cooled cylinder head according to claim 2, wherein an additional cooling duct is provided on the inflow side of the cooling water, which additional cooling duct supplies the common annulus section on a direct path additionally with cooling water.

6. Water-cooled cylinder head according to claim 1, wherein the wall thickness of the part-spherical combustion chamber cap in the area of the annulus section is reduced to between 5 and 11 mm.

7. Water-cooled cylinder head according to claim 6, wherein an additional cooling duct is provided on the inflow side of the cooling water, which additional cooling duct supplies the common annulus section on a direct path additionally with cooling water.

8. Water-cooled cylinder head according to claim 1, wherein an additional cooling duct is provided on the inflow side of the cooling water, which additional cooling duct supplies the common annulus section on a direct path additionally with cooling water.

9. Water-cooled cylinder head according to claim 1, wherein the water cooling jacket has an essentially uniform thickness in the area of the part-spherical combustion chamber cap and of the inlet and outlet ducts, which thickness amounts to between 3 and 7 mm.

10. Water-cooled cylinder head according to claim 1, wherein on the inflow side into the cylinder head cooling space, a main cooling flow extends between the two outlet valves in a direction of a receiving opening for the spark plug, while two secondary cooling flows are provided at two edge areas of the cylinder head cooling space.

11. Water-cooled cylinder head according to claim 10, wherein local contractions for throttling the two secondary cooling flows are provided in the two edge areas of the cylinder head cooling space.

12. Water-cooled cylinder head according to claim 10, wherein the diameter of the receiving opening for the spark plug is reduced at the level of the common annulus section.

13. Water-cooled cylinder head according to claim 12, wherein the wall thickness of the part-spherical combustion chamber cap in the area of the annulus section is reduced to between 5 and 11 mm.

14. Water-cooled cylinder head according to claim 10, wherein the wall thickness of the part-spherical combustion chamber cap in the area of the annulus section is reduced to between 5 and 11 mm.

15. Water-cooled cylinder head according to claim 10, wherein the water cooling jacket has an essentially uniform thickness in the area of the part-spherical combustion chamber cap and of the inlet and outlet ducts, which thickness amounts to between 3 and 7 mm.

16. Water-cooled cylinder head according to claim 1, wherein said cylinder head is composed of a standard alloy of AlSi6Cu4 or AlSi7MG.

17. Water-cooled cylinder head for a multicylinder internal combustion engine comprising:

a receiving opening for a spark plug, a pair of outlet valve receiving openings, a recess means for a pair of inlet valves, a part spherical cap forming a combustion chamber volume, and cylinder head cooling spaces extending above the part spherical cap and including:

inflow and outflow openings, water cooling spaces around the outlet valve receiving openings, and a common water cooling jacket annulus section around the receiving opening for the spark plug mutually connecting the water cooling spaces, wherein at least the common water cooling jacket annulus section has a volume which remains an essentially constant distance from the combustion chamber volume, so that, at least in this area, the wall thickness of the part spherical cap extends in a uniform manner and to close to the combustion chamber volume.

18. Water-cooled cylinder head according to claim 17, wherein the diameter of a receiving opening for the spark plug is reduced at the level of the common annulus section.

19. Water-cooled cylinder head according to claim 17, wherein the wall thickness of the part spherical cap in the area of the annulus section is reduced to between 5 and 11 mm.

20. Water-cooled cylinder head according to claim 17, wherein an additional cooling duct is provided on the inflow side of the cooling water, which additional cooling duct supplies the common annulus section on a direct path additionally with cooling water.

* * * * *